United States Patent [19]

Matsuda

[11] Patent Number: 4,543,073

[45] Date of Patent: Sep. 24, 1985

[54] SELF-PROPELLED RECONFIGURABLE RUNNING TOY

[75] Inventor: Takashi Matsuda, Tokyo, Japan

[73] Assignee: Takara Co., Ltd., Tokyo, Japan

[21] Appl. No.: 584,465

[22] Filed: Feb. 28, 1984

[30] Foreign Application Priority Data

Nov. 30, 1983 [JP] Japan ..... 58-184846[U]
Dec. 15, 1983 [JP] Japan ..... 58-193189[U]
Dec. 15, 1983 [JP] Japan ..... 58-193190[U]

[51] Int. Cl.[4] ..... A63H 27/00; A63H 11/10

[52] U.S. Cl. ..... 446/230; 446/289; 446/487; 446/457

[58] Field of Search ..... 446/95, 94, 93, 97, 446/268, 269, 289, 290, 292, 308, 311, 324, 396, 436, 437, 230, 331, 457, 470, 462, 464, 465, 487, 291

[56] References Cited

U.S. PATENT DOCUMENTS 596,109 12/1897 Gedney ..... 446/291 X
1,989,732 2/1935 Barrett .
3,540,152 11/1970 Beny et al. .
3,816,958 6/1974 Winston .
3,892,086 7/1975 Gay et al. .
4,300,308 11/1981 Ikeda ..... 446/457
4,363,187 12/1982 Shinohara ..... 446/437
4,490,124 12/1984 Ogawa ..... 446/464

FOREIGN PATENT DOCUMENTS 665971 9/1938 Fed. Rep. of Germany .

*Primary Examiner*—Mickey Yu
*Attorney, Agent, or Firm*—Price, Gess & Ubell

[57] ABSTRACT

A self-propelled, reconfigurable running toy that can be transformed from a running vehicle mode into a robot shaped toy mode is provided. In the vehicle mode, the toy can run with leg portions thereof folded up and locked in position above a body portion. During its running motion, the leg portions suddenly extend straight forwards, so that the toy is enabled to take up an upright (standing) position by the reaction force generated by the sudden movement of the leg portions.

26 Claims, 10 Drawing Figures

SELF-PROPELLED RECONFIGURABLE RUNNING TOY

BACKGROUND OF THE INVENTION

This invention relates to a self-propelled, reconfigurable running toy which, when in a running vehicle mode, can travel with leg portions folded up and locked in position above a body portion, and is also so designed that, while running, the folded-up portions can suddenly extend straight forward to assume the form of legs so that the toy has a robot-like shape.

The toy of this invention is so constructed that the folded-up portions can suddenly extend rotatably while the toy is travelling so that the toy is rotated into an upright (standing) posture by the reaction force generated by the sudden movement of the folded-up (leg) portions.

The following problems were involved in the realization of such a reconfigurable running toy.

The first problem was that, in order to ensure the maintenance of a stable standing-up posture of the toy, it was necessary to concentrate the reaction force created by the rapid rotational movement of the leg portions, which is the motive force producing the standing-up motion, and it was found that the toy was unable to sustain a stable, upright, standing posture unless this reaction force was controlled so as to lie within a certain specified range.

The second problem concerned a means for stopping the leg portions instantaneously just at the position at which they have extended straight forwards relative to the toy body portion. This is essential to enable the entire toy assembly, including its upper half, to achieve a standing-up motion under the reaction force produced by the rapid rotational extension movement of the folded-up portions of the toy when in a running mode.

The third problem resided in the necessity for providing a means for eliminating any excess reaction force that would remain after the toy has achieved its standing posture. If any excess reaction force remains after the toy has taken up its standing posture, this might force the toy to tumble forward.

SUMMARY OF THE INVENTION

The present invention provides a self-propelled, reconfigurable running toy which, when in a running mode, can run with leg portions locked in a folded-up position above a toy body portion against a constant rotational force urging the leg portions to extend. When the leg portions are released from the lock position during the running motion, the leg portions suddenly extend rotatably to their full length, causing the toy to take up an erect posture by the reaction force produced by the leg portions.

As a feature of this invention, a member for expediting the standing motion of the toy is provided at a lower part of the toy body portion to serve as a fulcrum for the standing motion, the member being so designed that it projects by a certain distance. A means is also provided for defining the range of rotation of the leg portions when they are released from the lock position, so that the leg portions can take up a substantially extended-forward position relative to the body portion. Further, an auxiliary wheel assembly is mounted at the end of each leg portion to enable the toy to move while maintaining its standing posture.

The features of the present invention which are believed to be novel are set forth in detail in the appended claim. The present invention, both as to its organization and manner of operation, together with further objects and advantages thereof, may best be understood by reference to the following description, taken in connection with the accompanying drawings.

DETAILED DESCRIPTION OF THE PREFERRED EMBODIMENTS

The following description is provided to enable any person skilled in the toy industry to make and use the present invention and sets forth the best modes contemplated by the inventor for carrying out his invention. Various modifications, however, will remain readily apparent to those skilled in the art, since the generic principles of the present invention have been defined herein specifically to provide a novel self-propelled reconfigurable running toy.

The accompanying drawings show an embodiment of the invention applied to the type of toy which can be transformed from a running vehicle form into a robotic humanoid, or vice versa. That is, the self-propelled reconfigurable toy according to this invention can take either the form of a running toy (FIG. 1) when folded up, or the form of a toy robot (FIG. 2) when extended. The toy consists essentially of a body portion 2 and a pair of leg portions 3 rotatably secured to the body portion 2 so that they can be rotated up or down (i.e., folded up or extended), each of the leg portions having a sole surface 30 traverse to the longitudinal axis of the toy.

Figure 1:
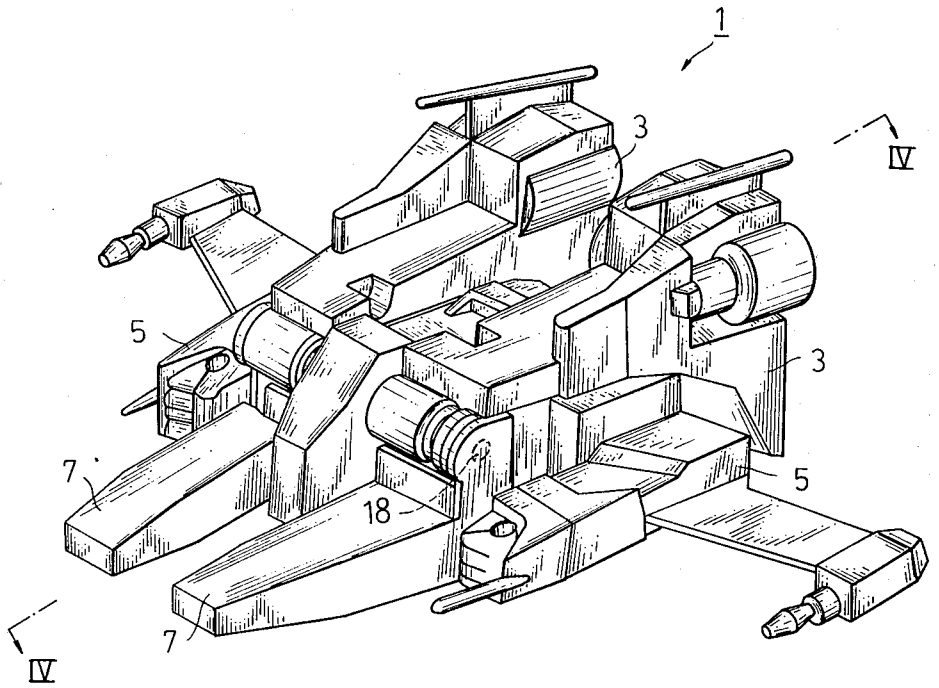
FIG. 1 is a general perspective view of a self-propelled, reconfigurable running toy in accordance with this invention, the toy being shown in a running mode with its leg portions folded up into a locked position.
Figure 2:
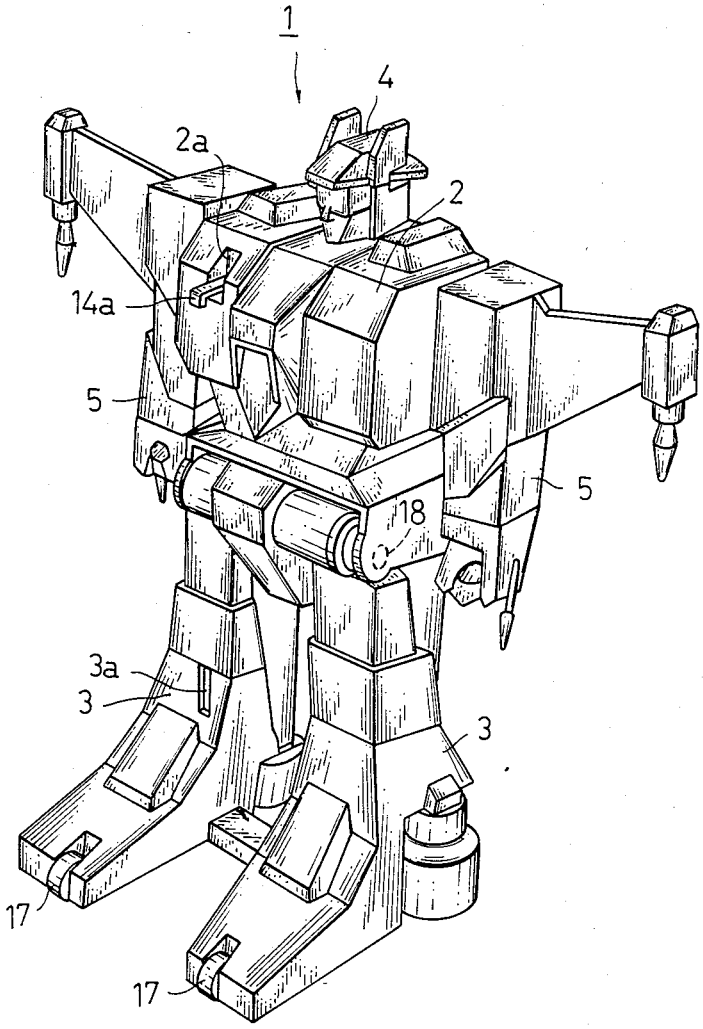
FIG. 2 is also a general perspective view of the toy of FIG. 1, reconfigured into a standing robot-like figure with the leg portions extended.

This reconfigurable toy 1 can be changed from the folded-up state shown in FIG. 1 into the extended state shown in FIG. 2, or vice versa.

The mechanism and structural parts of the toy 1 of this invention will now be described in detail.

Referring to the mode in which the toy can be played with as a robot (FIG. 2), a protuberance 4 with the appearance of a head is provided at the top end of the body portion 2, and a pair of arms 5 are rotatably mounted on either side of the body.

The rear of the body portion 2 has a first surface 40 which, when the toy is folded up as shown in FIG. 1, constitutes the bottom surface of the running toy. Projecting from this rear surface, at positions close to the shoulder portions, are a pair of wheels 6 (FIG. 3) for facilitating the movement of the toy when in running mode. Although there are two of these wheels shown in the embodiment, any number of wheels can be selected as required.

Figure 3:
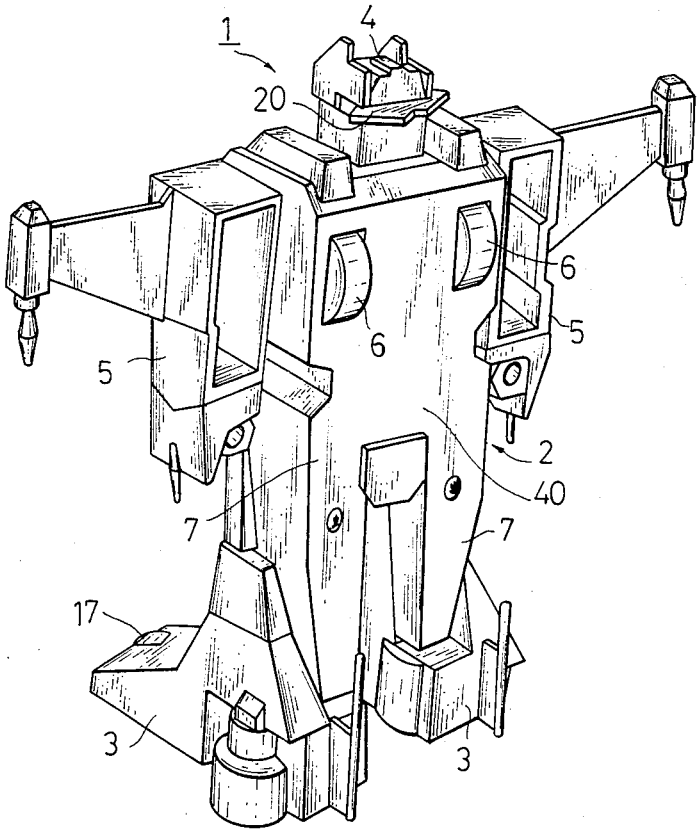
FIG. 3 is a rear perspective view of the embodiment of FIG. 2.
Figure 4:
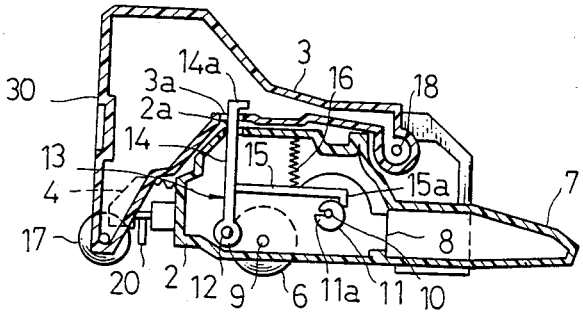
FIG. 4 is a longitudinal section taken along the line IV—IV of FIG. 1, showing the internal mechanism.

A pair of projections 7 are integrally formed at the lower end of the first surface 40 on the rear of the body portion 2, as shown in FIGS. 3 and 4, the projection being designed to abut against the rear of the leg portions 3 when in the robot mode (in the standing configuration) to restrict the rotation of the leg portions 3.

A known pull-back type of spring-powered prime mover assembly 8 is housed in the body portion 2, as shown in FIG. 4. This prime mover assembly 8 (shown in perspective in FIG. 5) is attached to the inside of the first surface 40 of the body portion 2 and consists of, although not shown in the drawings, a spring and a gear train linked to the spring. A shaft 9 passes through a section of the prime mover assembly close to one end, so that the shaft 9 is given a driving force to rotate the wheels 6 mounted at either end of the shaft 9.

A cam 11 is mounted on the prime mover output shaft 10 which rotates at a low speed, to act as a means for releasing the lock of the leg portions, the cam 11 having a pawl 11*a*.

A lever 13 is provided on the outside of the shaft 9 side end of the prime mover assembly 8 so that the lever 13 can rotate about a shaft 12. The lever 13 is T-shaped and has a hook 14*a* at the end of a vertical portion 14 thereof. A horizontal portion 15 of this T-shaped lever 13 also has a hook 15*a* formed at its end. The hooked end of the vertical portion 14 of the lever 13 projects from an opening 2*a* formed in the chest portion on one side of the body 2, for example on the left side as you face the robot (see FIGS. 2 and 4). The hook 15*a* at the end of the horizontal portion 15 is so positioned that it can engage with the pawl 11*a* of the cam 11 (see FIG. 4).

Figure 5:
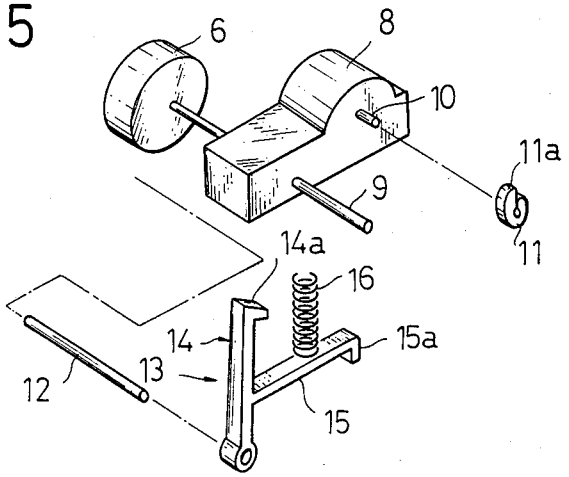
FIG. 5 is an exploded perspective view of the drive mechanism.

A compressed spring 16 is positioned between the horizontal portion 15 of the lever 13 and the inner wall of the body 2 so that the lever 13 is always given a turning force in the clockwise direction in FIG. 5. Thus the end of the horizontal portion 15 normally stays in contact with the cam 11 and, accordingly, when the cam 11 turns in the counterclockwise direction in FIG. 4 when the toy is in a running mode, an arcuate portion of the pawl 11*a* of the cam 11 engages with the hook 15*a* to make the lever 13 turn in the counter-clockwise direction in FIG. 5 to release the hook 14*a* from the engaged leg portions, as described in more detail below.

Since the cam 11 fits tightly onto the output shaft 10 to provide a frictional engagement therebetween, the cam 11 is forced to turn with the output shaft 10 unless sufficient external force is exerted on the cam 11 to inhibit its motion.

An opening 3*a* is formed in the leg portion 3 on the same side of the robot as the chest portion from which the hooked end 14*a* of the T-shaped lever 13 projects. When the toy is folded up, the hook 14*a* fits into the opening 3*a* and engages with its peripheral edge, thus holding the leg portions 3 in their folded-up position.

The sole of each leg portion 3 has a surface (second surface) 30 which is perpendicular to the longitudinal axis of the toy body and has a sufficient area to enable the toy to take up and maintain a standing posture. An auxiliary wheel 17 for movably supporting the standing toy 1 is rotatably mounted on the toe side of each second surface 30. These wheels 17 at the base of the leg portions engage with the support surface when the toy 1 is standing in the form of a robot. Therefore, when there is still excess turning moment acting in the forward direction on the toy 1 after it has assumed the standing posture, the toy is forced to make a forward inertial movement with the aid of the wheels 17, while keeping its standing posture, so that the excess turning moment in the forward direction is cancelled out. Thus, the toy when in a standing mode (in the form of a robot) can securely maintain its standing posture with minimal danger of falling forward.

The leg portions 3 are rotatably (foldably) attached to the body portion 2 by a shaft 18 secured to the lower end of the front of the body portion 2. The leg portions 3 form the upper or base member of the toy, while the body portion 2 forms the lower or frame portion. The frame member 2 has a longitudinal axis that is parallel to the support surface in a vehicle configuration. The body portion 2 rotates to a perpendicular alignment with the support surface when the toy is reconfigured into a standing robot. Although not shown, the shaft 18 is loaded by a torsion coil spring so that the legs 3, when folded up, are always urged to rotate in the extension direction by the force of the coil spring.

Figure 6:
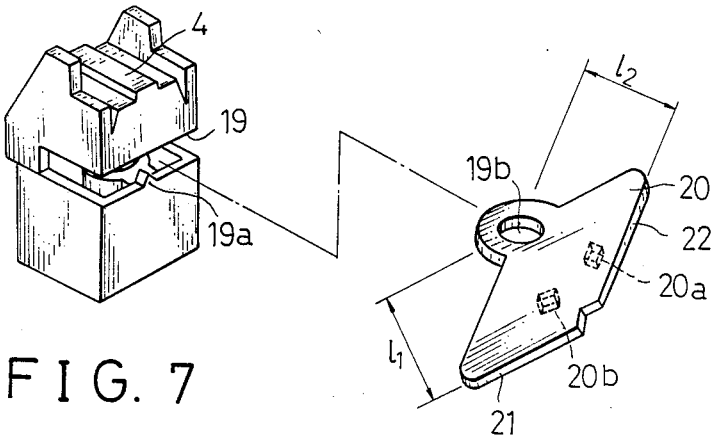
FIG. 6 is an exploded perspective view of a member expediting the standing motion, illustrating the manner of adaptation of said member.

At the rear of the head portion 4 a cutout 19 is provided, as shown in FIG. 6, and a rhomboidal member 20 for expediting the standing motion of the toy is fitted into the cutout 19 so that the member 20 can rotate about a shaft hole 19*b* formed toward one end of the shorter diagonal of the rhomboid. The shaft hole 19*b* is fitted onto a pin (not shown) in the cutout 19 so that the rhomboidal member 20 is freely rotatable about the pin. Recesses 20*a*, 20*b* are formed on the underside of the rhomboidal member 20, as shown by the broken lines in FIG. 6. These recesses 20*a*, 20*b* are designed to receive a protuberance 19*a* formed on the lower side of the cutout portion 19.

Figure 7:
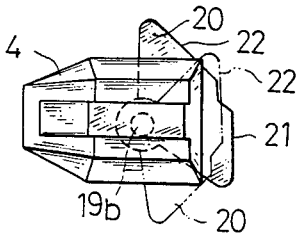
FIG. 7 is a plan view of the head portion of the toy when in its robot configuration.
Figure 8A:
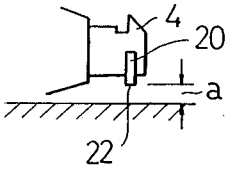
FIGS. 8 (A) and (B) illustrate the relationship between the standing motion expediting member and the floor surface.
Figure 8B:
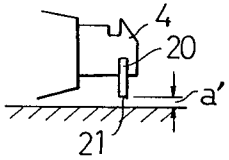

Edges 21, 22 of the member 20 protruding from the cutout 19 in the head portion 4 are at different distances $l_1$ and $l_2$ ($l_1 > l_2$) from the shaft hole 19*b* (FIG. 6). Therefore, if the member 20 is turned counterclockwise so that its edge 22 projects as shown in FIG. 7, the amount by which the member 20 protrudes is less than when the edge 21 projects. This is illustrated in FIGS. 8 (A) and (B). FIG. 8 (A) shows the condition where the edge 22 of the member 20 projects. In this case, the distance a between the member 20 and the support surface is large. FIG. 8 (B) illustrates the condition where the edge 21 projects, in which case the distance a' between the member 20 and the support surface is small.

This embodiment of the present invention will now be considered from the aspect of how to play with it.

First, the leg portions 3 are rotated upward about the shaft 18 against the elastic force of the torsion coil spring (not shown), and are thereby folded up into a position of which they lie over the body portion 2. The hook 14*a* of the lever 13 enters the opening 3*a* in one leg portion 3 (see FIG. 4). During the course of this movement, the hook 14*a* hits an edge of the opening 3*a* and, as the lever 13 rotates further counterclockwise in FIG. 4, against the opposing force of the spring 16, and the hook 14*a* is forced to pass over the edge of the opening 3*a* and is caught inside thereof (FIG. 4).

In this condition, the leg portions 3 are held folded-up against the force of the torsion coil spring (not shown) by the engagement of the hook 14*a*. Thus the leg portions 3 are placed atop the body portion with their rear surfaces facing upwards, and the projections 7 integral with the body portion 2 are positioned with their ends facing forwards, forming the running vehicle toy as shown in FIG. 1. In this form of the toy, the wheels 6 are positioned in engagement with the support surface to enable the running motion of the toy.

To make the toy run, when a known pull-back type of spring powered prime mover is used, the child holds the toy body, presses the wheels 6 against the support surface, and pulls the toy backward so that the spring (not shown) is wound up by the axle 9 of the wheels 6. The output shaft 10 on which the spring is loaded is also forced to turn clockwise in FIG. 4, causing a corresponding rotation of the cam 11. Consequently, the stepped portion of the pawl 11*a* of the cam 11 engages with the hook 15*a*, but since the cam 11 is only frictionally attached to the output shaft 10, the output shaft 10 alone is forced to turn clockwise while this engagement is maintained leaving the cam 11 slipping around the shaft, thereby winding up the spring (not shown).

When the child lets the toy go under this condition, the spring begins to unwind to make the wheels 6 rotate, causing the toy 1 to start running. As the output shaft 10 turns further counterclockwise in FIG. 4, the external arcuate portion of the cam pawl 11*a* hits the end of the hook 15*a* to raise it, forcing the lever 13 to turn counterclockwise in FIG. 4 against the elastic force of the spring 16, so that the hook 14*a* is disengaged from the edge of the opening 3*a*. Whereupon the leg portions 3 are urged to spring back to their extended position in relation to the body portion 2 by the restoring force of the torsion coil spring (not shown) wound around the shaft 18 which attaches the leg portions 3 to the body portion 2. As a consequence, the rhomboidal member 20 protruding from the rear end of the protuberance 4 is knocked against the support surface to produce a turning moment (reaction force) in response to the action of the centrifugal force generated by the rapid rotation of the leg portions 3. This jerks the toy, which has now been transformed into a robot, up into the air, rotating it through about 90°, so that it lands on the floor with the sole surfaces (second surfaces) 30 of the leg portions 3 engaging with the support surface.

The force with which the projecting member 20 is knocked against the floor surface can be controlled by changing the distance between the member 20 and the floor surface by turning the member as illustrated in FIGS. 8 (A) and (B), and it is thereby possible to adjust the reaction force required for bringing the toy to its erect posture, thus ensuring that the toy can perform its standing motion.

Because of the provision of the pair of projections 7 which serve as means for restricting the rotation of the leg portions when they are released so that they can take up a substantially extended straight posture relative to the body portion of the toy, the leg portions can be brought to an instantaneous stop when they have reached their extended position after being released from their folded-up position, making it possible to produce a large reaction force.

There will still be an excess reaction force when the toy has just landed on the floor surface, but since the auxiliary wheels 17 are provided at the ends of the leg portions 3, the toy 1 is able to make an inertial movement for an appropriate distance while maintaining its standing posture, so that any remaining moment in the forward direction is cancelled out. In other words, any excess force remaining after the toy has reached its standing posture is converted into a force which acts to let the toy make a forward inertial movement while maintaining its standing posture. This enables the sure and stable landing of the toy on the support surface with no danger of it tumbling forward, after it has assumed the standing posture.

Figure 9:
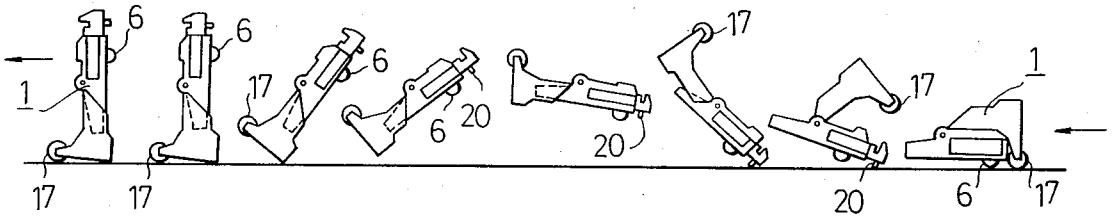
FIG. 9 are is sequential sketches of the toy, illustrating the process of its reconfiguration.

The sequential motion of the toy during its transformation in play mode, until it assumes its standing posture as a robot is illustrated in FIG. 9.

Persons skilled in the toy field would be capable of modifying the various embodiments of the present invention within its generic teachings.

Accordingly, the scope of the present invention should be measured solely from the following claims, wherein I claim:

1. A self-propelled reconfigurable running toy capable of both a translational and predetermined rotational movement while it is being played with, comprising a frame member having a longitudinal axis;

a wheel assembly attached to the frame member;

a motor assembly attached to the frame member and which is capable of operatively driving the wheel assembly for translational movement across a support surface;

means for intentionally rotating the frame member about an axis transverse to the longitudinal axis so that the longitudinal axis is positioned at approximately a 90° angle to its original initial position at the start of its translational movement during a predetermined period of its translational movement, including a base member for mounting the running toy on said support surface; and means for varying the force generated during rotation of the frame member including a member for varying the contact distance between one end of the frame member and the support surface when the base member is rotated, wherein said running toy can be stood up on said support surface by said base member when said frame member rotates about the axis traverse to the longitudinal axis during the predetermined period of its translational movement.

2. The invention of claim 1 wherein the frame member simulates the body of a humanoid robot and the base member simulates the legs of a humanoid robot.

3. The invention of claim 2 wherein the frame member has front surface which is positioned on the top of the toy in a vehicle configuration, the base member is pivotally mounted at the top front surface of the frame member and at least one spring member biases the base member to rotate about the top front surface.

4. The invention of claim 3 including a pair of stop members extending forward of the frame member and parallel to the longitudinal axis.

5. A reconfigurable toy that can be converted from a vehicle that can move across an approximately horizontal support surface into a robot comprising:

a frame member having a longitudinal axis approximately parallel to a support surface in a vehicle configuration, the frame member also simulating the body of a robotic figure;

means for translating the frame member across a support surface;

a chassis member movably mounted to the frame member and capable of extending outward from the frame member by approximately 180° from a vehicle position above the frame member to a robot position, the chassis member simulating the legs of a robotic figure;

means for biasing the chassis member to an extended position in alignment with the longitudinal axis of the frame member, and means for releasing the chassis member when folded above the frame member during the translation of the toy in a vehicle configuration including means for moving the chassis member away from the frame member whereby the rotational forces created by the movement of the chassis member above the frame member rotates the frame member so that the longitudinal axis is automatically positioned at approximately a 90° angle to its original initial position parallel to the support surface when the toy terminates its movement and assumes a robot configuration.

6. The invention of claim 5 wherein the means for translating the frame member across a support surface include at least a pair of wheels mounted on the frame member.

7. The invention of claim 6 further including a motor mounted in the frame member for driving the wheels.

8. The invention of claim 5 further including means on the frame member for varying the rotational forces generated by the chassis member to insure a standing robotic configuration when the toy terminates its movement.

9. The invention of claim 5 wherein the means for biasing forces the chassis member in the same direction that the frame member is translating across the support surface.

10. The invention of claim 9 wherein the frame member simulates the body of a humanoid robot and the chassis member simulates the legs of a humanoid robot.

11. The invention of claim 10 wherein the chassis member is pivotally mounted at a surface of the frame member and at least one spring member biases the base member to rotate about the pivot point.

12. The invention of claim 11 including a pair of stop members extending forward of the frame member and parallel to the longitudinal axis.

13. The invention of claim 12 further including means on the frame member for varying the rotational forces of the chassis member to insure a standing robotic configuration when the toy terminates its movement.

14. The invention of claim 9 wherein the chassis member is bifurcated to simulate a pair of legs and wheels are provided on each leg.

15. The invention of claim 15 wherein the physical configuration of the chassis member and frame member simulate an aircraft when folded together.

16. A reconfigurable toy capable of both a translational movement across a support surface in a first configuration and an automatic conversion into a second configuration at a predetermined time, the second configuration being positioned approximately 90° rotated from the longitudinal axis of the first configuration, comprising:

a first member having a longitudinal axis with a forward end and a rear end relative to direction of movement of the toy;

wheel means for permitting movement of the first member in a first configuration across a support surface; a second member pivotally attached to the forward end of the first member;

means for biasing the second member to an extended position in alignment with the longitudinal axis of the first member;

means for retaining the second member in a folded position above the first member;

means for releasing the second member, the second member having sufficient weight for rotation about its pivot point to initially lift the forward end from the support surface in a first direction and to cause a reaction force to then subsequently rotate it in a second direction whereby the second configuration is formed and is finally positioned upright at 90° from the original position of the longitudinal axis.

17. The invention of claim 16 further including means for varying the degree of force generated during rotation of the first member.

18. The invention of claim 17 wherein the means for varying the degree of force includes a member for varying the contact distance between the rear end of the first member and the support surface when the second member is initially rotated about the pivot point.

19. The invention of claim 18 wherein the first member simulates the body of a humanoid robot and the second member simulates the legs of a humanoid robot.

20. The invention of claim 19 including a pair of stop members extending forward of the frame member and parallel to the longitudinal axis.

21. The invention of claim 19 wherein the first member includes a robotic head configuration and the means for varying the force includes a rotable lever that can be positioned at varying distances from the support surface.

22. The invention of claim 10 wherein the first member includes a pair of robotic arm appendages.

23. The invention of claim 22 wherein the first member includes a pair of wings.

24. The invention of claim 23 wherein the legs include wheels along one edge only.

25. The invention of claim 24 wherein a spring-propelled motor is mounted in the first member.

26. The invention of claim 25 wherein the means for releasing the second member is intiated by the spring-propelled motor.

* * * * *